US006508385B1

(12) United States Patent
Liardon

(10) Patent No.: US 6,508,385 B1
(45) Date of Patent: Jan. 21, 2003

(54) HOUSING CONTAINING A REPLACEABLE FLEXIBLE PACKAGING UNIT

(75) Inventor: Olivier Liardon, Le Mont-sur-Lausanne (CH)

(73) Assignee: SICPA Holding, S.A., Prilly (CH)

( * ) Notice: Subject to any disclaimer, the term of this patent is extended or adjusted under 35 U.S.C. 154(b) by 0 days.

(21) Appl. No.: 09/622,374

(22) PCT Filed: Feb. 16, 1999

(86) PCT No.: PCT/EP99/00998

§ 371 (c)(1),
(2), (4) Date: Feb. 15, 2001

(87) PCT Pub. No.: WO99/44914

PCT Pub. Date: Sep. 10, 1999

(30) Foreign Application Priority Data

Mar. 3, 1998 (EP) ..... 98103696

(51) Int. Cl.[7] ..... B65D 35/28

(52) U.S. Cl. ..... 222/95; 222/105; 222/386; 222/326

(58) Field of Search ..... 222/95, 105, 386, 222/326, 103

(56) References Cited

U.S. PATENT DOCUMENTS

| | | | | | |
|---|---|---|---|---|---|
| 1,583,813 | A | * | 5/1926 | Thwaites | 222/93 |
| 2,587,191 | A | * | 2/1952 | Merullo | 222/103 |
| 3,323,682 | A | * | 6/1967 | Creighton, Jr. et al. | 222/94 |
| 4,989,743 | A | * | 2/1991 | Lowery | 220/85 |
| 5,046,648 | A | * | 9/1991 | Herbstzuber | 222/638 |
| 5,114,240 | A | * | 5/1992 | Kindt-Larsen et al. | 366/129 |
| 5,161,715 | A | * | 11/1992 | Giannuzzi | 222/83 |
| 5,301,835 | A | * | 4/1994 | Fulks et al. | 222/95 |
| 5,332,122 | A | | 7/1994 | Herold et al. | |
| 5,370,221 | A | | 12/1994 | Magnusson et al. | |
| 5,443,181 | A | * | 8/1995 | Popp et al. | 222/95 |
| 5,650,180 | A | * | 7/1997 | Kumada et al. | 425/376.1 |
| 5,873,970 | A | * | 2/1999 | Konuma et al. | 156/197 |
| 5,897,028 | A | * | 4/1999 | Sauer | 222/82 |

FOREIGN PATENT DOCUMENTS

| | | | | |
|---|---|---|---|---|
| DE | 248278 | A2 * | 12/1987 | B65D/83/00 |
| DE | 92 07 385 | | 9/1992 | |
| DE | 196 43 664 | | 5/1998 | |
| EP | 0 151 922 | | 1/1985 | |
| EP | 0 248 278 | | 5/1987 | |

* cited by examiner

*Primary Examiner*—Henry C. Yuen
*Assistant Examiner*—Frederick C. Nicolas
(74) *Attorney, Agent, or Firm*—Shoemaker and Mattare

(57) ABSTRACT

A housing is integrated with a flexible packaging unit for compositions of pasty consistency. The flexible packaging unit comprises a flexible projection by which contact of the content of the package with the elongated spout of the housing is avoided when the package is integrated with the housing. Clogging of the elongated spout is prevented.

6 Claims, 3 Drawing Sheets

HOUSING CONTAINING A REPLACEABLE FLEXIBLE PACKAGING UNIT

The invention relates to a housing with an integrated replaceable packaging unit for compositions of a pasty consistency and to a flexible packaging unit which comprises a flexible projection. The packaging unit is especially suitable as a container for oxygen sensitive substances.

Flexible packaging units having substantially tubular bodies with ends being closed by e.g. metal clips or compressed rings are state of the art. One very common example is the application of this type of packaging unit for the packing of pasty foodstuff, above all for sausage-meat, thereby giving sausages their typical form.

The German utility model G 9207385.9 describes a cylindrical foil packaging unit with convexly bent ends, being closed by tube clips. This type of packaging system was especially developed for oxygen sensitive offset printing inks.

This improvement for packaging systems suitable for oxygen sensitive printing inks which were used up to this time was directed towards a better storage stability and a better exclusion of oxygen during the filling and emptying process. However in certain respect it shows insufficiencies:

- the width of the opening, corresponding to the whole circumference of the cylindrical body once the closing is removed, makes difficult the repeated opening and closing necessary when just parts of the content are needed; particularly when only very small amounts are taken out.
- moreover the resultant large surface of contact with air would inevitably lead to a decrease of quality of the composition.
- additionally, the width of the opening makes an exact dosage of content a time-consuming operation risking exhaustive contact with air.

With regard to the latter problem, the insertion of said cylindrical flexible packaging unit in an conventional type of piston-cylinder dispenser was described. However, using this the content of the packaging system comes into contact with the protruded end of the dispenser, causing the well known effect of clogging of the opening after repeated applications.

The same happens with solid cartridges having solid elongated dispensing openings. Said cartridges are well known for the dispensing of adhesive and sealing materials. Usually this type of solid cartridge is clamped in a rigid housing for reasons of better handling.

This kind of combination of dispenser and packaging unit does not enable the use of packaging unit over a long period because of clogging.

The problem to be solved by the present invention is to provide a flexible packaging unit which do not show the described drawbacks.

This problem is solved with a housing containing a replaceable packaging unit made of a flexible material for the packing of compositions of a pasty consistency, whereby said housing comprises at one of its ends an elongated spout which is lined with a projection being part of said packaging unit which is longer than the elongated spout of the housing.

The flexible packaging unit for compositions of pasty consistency consists of a substantially tubular body having one end closed and having a projection at the other end which is reduced in its opening width, and particularly in its diameter, in contrast to that of the substantially tubular body.

Dispensing the pasty content through a projection of said packaging unit as described by the present invention enables:

- an exact application of small quantities even without any additional means;
- very easy re-closing by any type of closing means;
- high protection from oxygen (air) contact, since the closing means close the package air-tightly and since the entire content of the package is contained within the oxygen impermeable package.

In one embodiment of the invention, this packaging unit is formed by a foil tube which is closed at one end by well known methods e.g. tubular clips or welding seams. The projection is formed by at least one restricting means which compresses the circumference of the substantially flexible tube at a predetermined position and to a predetermined diameter.

In a preferred embodiment, said restricting means is adjustable in radial and longitudinal direction across and along the flexible tube in order to fix the opening diameter and the length of the projection.

Preferably the ratio of tubular body length to projection length is at least 1:0.2 to 1:0.5.

The projection is closed by any suitable means, in particular any type of clip can be used.

As further enhancement for protection against oxygen contact, the projection is evacuable after the filling process and can be optionally refilled with an inert gas, such as nitrogen.

Although the several advantages are achieved with just the features of the packaging unit alone, even better results in handling are obtainable by the already described combination of the packaging unit of the present invention and a housing which is specially adapted in respect to the form of said packaging unit.

The housing of the present invention generally has the form of a known piston cylinder applicator. It consists of a housing made of an inflexible or, at least, sufficiently press/force resistant material having at one of its ends an elongated spout and, on the other end, opposite to the elongated spout, a piston movable across the longitudinal axis of the housing for forcing the content of the packaging unit through the elongated spout by pressure. The projection of the packaging unit is adjusted in its dimensions so that the inner part of the elongated spout is lined by the projection and, therefore, does not come into contact with the pasty content of the packaging unit. By that means, clogging of the elongated spout is avoided.

The projection of the packaging unit is longer than the protruding end of the cartridge, when inserted. More exactly it is to such an extent longer that the upper end of the projection can be cut and closed by any conventional clip or any other means. In case the opening of the projection is clogged by hardened content, a simple cut of the end of the projection will again guarantee a free flow of the content.

Furthermore, with this special feature of combination of packaging unit and housing, the content of the packaging unit cannot come into contact with the housing and in particular not with the protruded end of the housing. This enables the user to exchange packaging units when they have been emptied. The exchange procedure is very simple due to a housing consisting of two separate parts. This kind of packaging unit ensures that there is no loss in quality of its content. Thus, even after repeated use of the same packaging unit over a long period, the quality of the product is comparable with that of an unused new one.

In a further embodiment of the present invention the housing comprises means in its elongated spout for emptying the projection of the packaging unit. This may be realised in that, in the lower part of the elongated spout in at least one inlet, a second piston is inserted, which is adjustable along the longitudinal axis of the elongated spout for emptying the projection of said foil packaging unit. This is of particular advantage for either expensive contents or contents which would lead to disposal problems should the packaging unit not be completely emptied.

Figure 1:
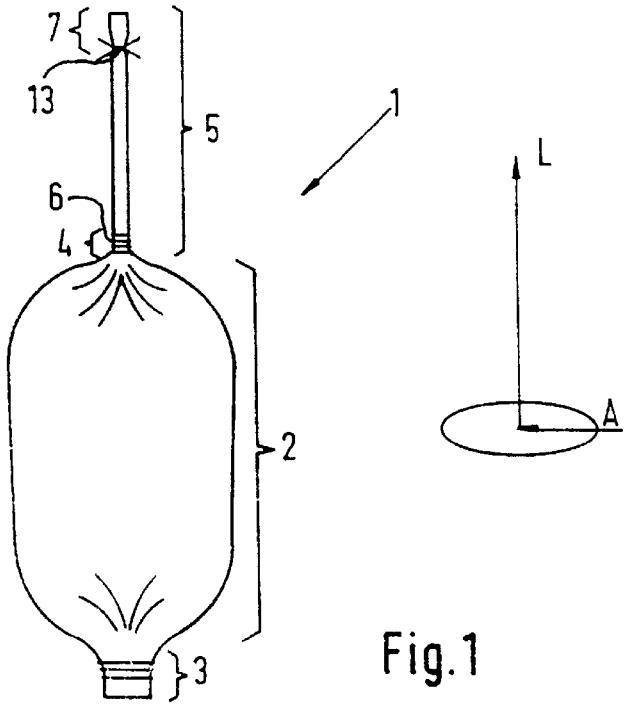
FIG. 1 shows the flexible foil packaging unit of the present invention.

FIG. 1 shows the flexible packaging unit 1 having a content of pasty consistency. The body 2 of the packaging unit 1 is substantially tubular and its one end 3 is closed by any conventional mechanical means such as clips, rings, etc.

Alternative possibilities for closing the edges of the lower end 3 are welding or gluing them together. The transition 4 to the projection 5 is formed by a restricting means 6 which compresses the circumference of the substantially tubular body 2 of the packaging unit 1. The restricting means 6 is adjustable in axial A and longitudinal L direction in order to determine the diameter and length of the projection 5.

The end 7 of the projection 5 is closed by a closing means, which are in a preferred manner mechanical clips The flexible packaging unit can be made of any suitable material and depends on the content of said packaging unit. For oxygen sensitive contents a material must be chosen which forms a barrier for oxygen. This means that the value of the diffusion constant for oxygen through this material has to be very small. Suitable materials are for example foils or laminates of aluminium, polyethylene or polypropylene.

Figure 2:
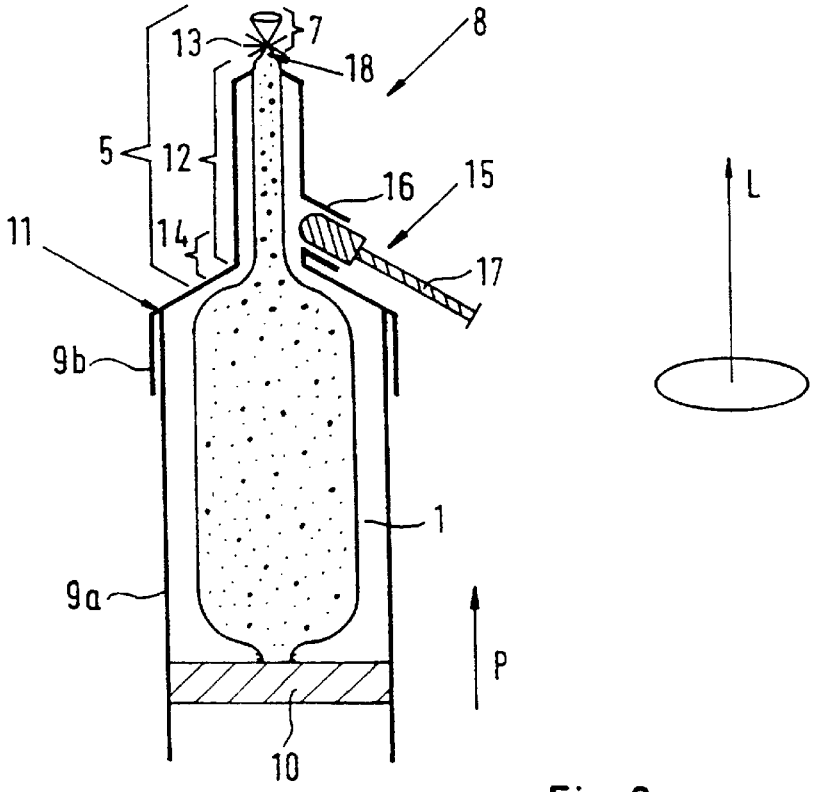
FIG. 2 shows a longitudinal cut through a combination of a housing and a packaging unit filled with a composition of pasty consistency.

In FIG. 2, the flexible packaging unit 1 is introduced in a housing 8 which belongs to the general type of piston-cylinder applicators. The applicator consists of a solid housing 9*a* and 9*b*, which are reversibly put together. Alternatively, of course, any other type of reversible connection is applicable. For example, these two parts can be provided with threads in order to hold them-together. The housing 9*a* at one end consists of a piston 10 which is movable along the longitudinal axis L of the housing 8. By pressing or screwing the piston 10 across the axis L to the upper end 11 of the housing 9*a*, the content of the flexible, substantially tubular packaging unit 1 is dispensed through its projection 5. The solid housing 9*b* has an elongated spout. Diameter and length of the projection 5 is fitted to diameter and length of the elongated spout. The projection 5 is inserted in the housing 8 and in particular in the elongated spout in such a way that the end 7 of the projection 5 juts out from the elongated spout far enough to allow attachment of a closing means. 13. In the lower part 14 of the elongated spout 12 an inlet 16 is attached to insert a second piston 15. Said piston 15 comprises an elongated stick 17 which has to be substantially the same length as the elongated spout 12. The piston 15 is movable along the longitudinal axis L of the elongated spout 12. By pushing up the piston to the end 18 of the elongated spout 12, the content of the projection 5 is pressed out.

Figure 3:
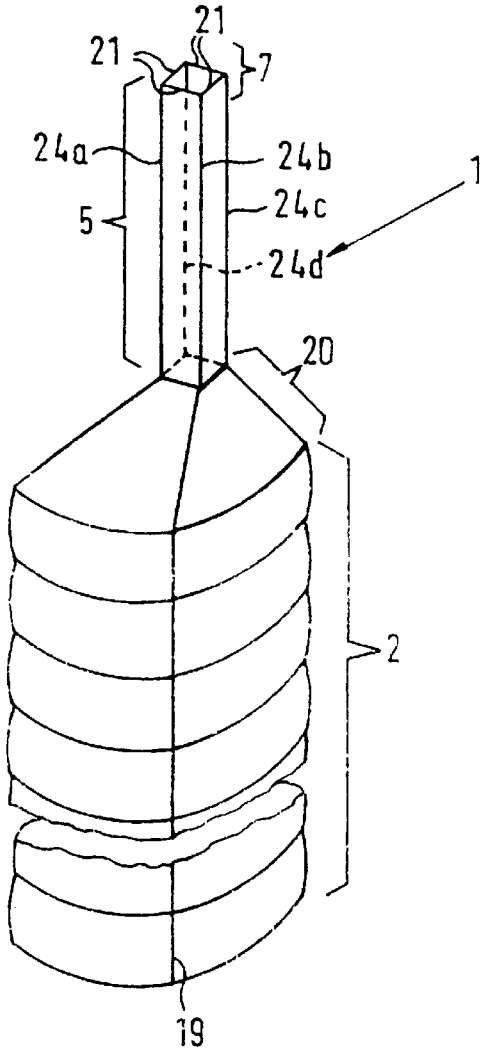
FIG. 3 shows an alternative form of a packaging unit of the present invention.
Figure 4:
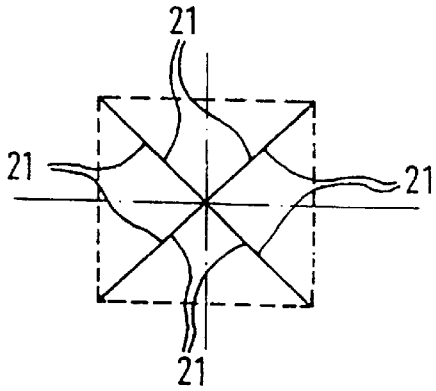
FIG. 4 shows the way of folding and closing the projection's opening of FIG. 3.

FIG. 3 shows an alternative form of the flexible packaging unit 1 of the present invention. The body 2 is substantially tubular comprising one seam 19. But even with two or more seams it would keep its substantially tubular form. The projection 5 is a square body with its adjoining edges attached lengthwise together. The attachment can be performed by any conventional means. In particular welding or gluing is applicable in order to get durable seams. In FIG. 4 the closure principle of the projection 5 at its upper end 7 is illustrated in top view. Each of the edges 21 is divided and the halves of adjoining edges 21 are attached together, thereby forming a symmetric cross. The transition part 20 is a square pyramid with an open top. It forms the transition from the substantially tubular body 2 with only one seam 19 to the square projection 5 with four seams (24*a–d*).

Figure 5:
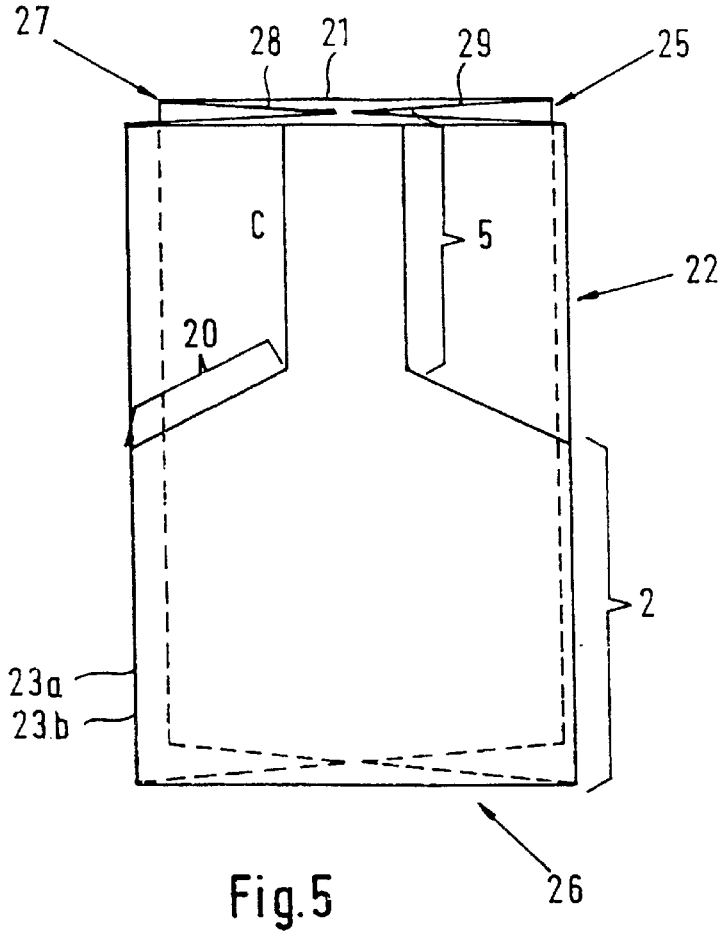
FIG. 5 shows the principle of folding a sheet of package material and cutting the packaging unit form out of the folded sheet.

Obviously, instead of 4 edges, a higher number of edges such as 6 or 8, the number still being even, is possible. FIG. 5 represents the way of producing the packaging unit of FIG. 3.

Figure 6:
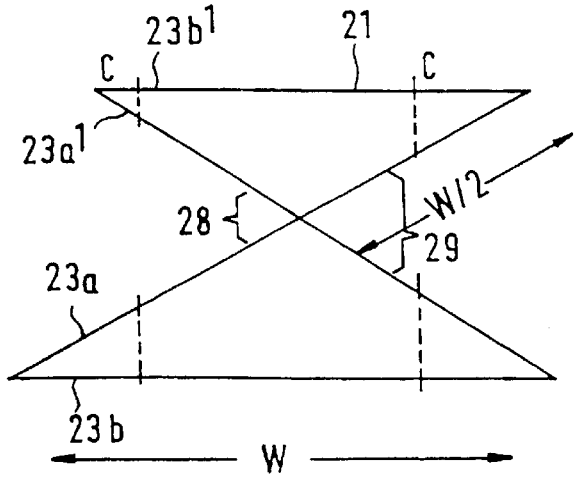
FIG. 6 shows a view of the upper and lower edges of the folded sheet of FIG. 5.

A foil sheet 22 which is the package material is folded as represented in FIG. 6. It shows in top view the upper 25 and lower 26 ends of the sheet 22. The sheet 22 having two side edges 23*a*, 23*b* is folded with inwardly directed pleats 28, 29 on two opposite sides and with the two side edges 23*a*, 23*b* lying above one another.

Segments from the pleats 28,29 can simply be cut out to form the projection 5 and the transition part 20 of the packaging unit 1.

The edges can simultaneously be cut and joined together along a cut and weld line C in the same step. In the same step, the side edges 23*a*, 23*b*, 23*a*$^1$, 23*b*$^1$ and upper and lower edges 21 can be joined together. The simultaneous cutting and joining is, however, not a basic requirement.

Two parts can be cut and welded together a the same time, a first part along the edges 23*a*, 23*b* and a second part along the edges 23*a*$^1$, 23*b*$^1$ along one and the same cut and weld line C, when the pleated foil shown in FIG.6 is pressed in a flat shape. A foil material consisting of at least two layers with different welding properties allows 23*a*, 23*b* and 23*a*$^1$, 23*b*$^1$ to be joined without joining the edges 23*a*$^1$ and 23*a*. The layer directed to the interior of the package must be weldable (consisting e.g. of polyethylene or polypropylene) while the layer directed towards the exterior is not weldable under the same conditions (consisting e.g. of polyester).

This way of folding the sheet 22 provides the possibility of cutting out the packaging unit form and joining all open edges simultaneously in one step, permitting a very economic and fast way of packaging unit production.

What is claimed is:

1. A housing containing a replaceable flexible packaging unit for composition having a pasty consistency, said packaging unit comprising a substantially tubular body of a first length and a first diameter, said body comprsing a closed end and a flexible projection of a second length and of a second diameter opposite to said closed end, said housing being equipped with a moveable piston and further comprising an elongated spout, said second length being selected in such a way that said spout is lined with said projection of said packaging unit over its entire length such that the composition of the packaging unit does not come into contact with the housing, and said spout comprises means for emptying flexible projection of said packaging unit.

2. A housing according to claim 1, wherein said means comprises at least one inlet containing at least one piston displaceable along the spout for emptying said flexible projection of said packaging unit by pressure.

3. A housing according to claim 1, wherein the second diameter of the packaging unit is smaller that the first diameter of the packaging unit.

4. A housing according to claim 1, wherein the tubular body comprises a restricting means for compressing the body at a predeterminable position, thereby determining the diameter of the flexible projection.

5. A housing according to claim 4, wherein said restricting means is moveable along the tubular body of the packaging unit for adjusting the length of said flexible projection.

6. A housing according to claim 1, wherein the flexible projection is formed such that it is evacuable.

* * * * *